US005705808A

United States Patent [19]

Filo

[11] Patent Number: 5,705,808

[45] Date of Patent: Jan. 6, 1998

[54] FLASH TUBE DEVICES WITH A CONTROLLABLE ELECTRICAL ENERGY

[75] Inventor: Andrew S. Filo, Cupertino, Calif.

[73] Assignees: Dittler Brothers Incorporated, Atlanta, Ga.; Simon Marketing, Inc., Los Angeles, Calif.

[21] Appl. No.: 597,928

[22] Filed: Feb. 7, 1996

Related U.S. Application Data

[62] Division of Ser. No. 306,865, Sep. 15, 1994, Pat. No. 5,497,001.

[51] Int. Cl.[6] ..... H01J 40/14

[52] U.S. Cl. ..... 250/214 P; 250/205; 315/156

[58] Field of Search ..... 250/214 P, 205, 250/206, 214 RC, 214 SF, 316.1, 317.1, 214 DC; 315/151, 156, 152, 149, 159, 227 R, 241 P, 240; 354/145.1, 416; 396/167, 176–179

[56] References Cited

U.S. PATENT DOCUMENTS

| | | | |
|---|---|---|---|
| 3,033,988 | 5/1962 | Edgerton . | |
| 3,350,604 | 10/1967 | Erickson | 315/151 |
| 3,648,104 | 3/1972 | Ackermann | 250/205 |
| 3,684,917 | 8/1972 | Uno et al. | 250/205 |
| 4,249,109 | 2/1981 | Ogawa | 250/214 DC |
| 5,134,273 | 7/1992 | Wani et al. | 250/205 |
| 5,151,595 | 9/1992 | Filo | 250/316.1 |

*Primary Examiner*—Que Le

*Attorney, Agent, or Firm*—Dean W. Russell; Kilpatrick Stockton LLP

[57] ABSTRACT

A flash device has a flash tube which generates light in response to electrical energy. The amount of light emitted by the flash tube is monitored by a circuit which is connected to means for adjusting the electrical energy supplied to said flash tube when a predetermined amount of light has been emitted to thereby increase the effective life span of the flash tube and maintain intensity level of the flash tube within a given tolerance.

3 Claims, 5 Drawing Sheets

FLASH TUBE DEVICES WITH A CONTROLLABLE ELECTRICAL ENERGY

This application is a divisional of U.S. patent application Ser. No. 306,865, filed Sep. 15, 1994, having the same title, now U.S. Pat. No. 5,497,001.

BACKGROUND OF THE INVENTION

1. Field of the Invention

The present invention is related in general to flash tube devices and in particular to prolonging the ability of a flash tube to produce light with a preferred intensity.

2. Description of Related Art

Flash tubes have been used in many applications, such as photography, photocopying, aircraft traffic control and stroboscopes, to provide flashes of high intensity light for film development, guidance and the like. A flash tube is generally formed by an envelope, such as a tube made of quartz or silicon dioxide, which encloses two electrodes and a small amount of noble gas such as Xenon. Typically, the electrodes are connected in parallel with a capacitor, which will be charged to a high voltage during operation. As the capacitor is charged, the voltage across the electrodes will increase. However, because the gas normally has a high resistance (typically at 10 megohm), no electric current will flow across the electrodes until a high voltage pulse is applied to a trigger electrode of the tube, at which time the gas will be ionized. When the gas is ionized, its resistance is reduced significantly (typically down to about 1 ohm) and the electric charge stored in the capacitor will discharge through the ionized gas, emitting light.

Along with the light, heat is emitted during the discharge. The heat raises the temperature of the flash tube and often creates cracks in the envelope, through which the gas may escape. The high electrical voltage applied to the electrodes may also cause the electrodes to wear, a process commonly known as "electrode pitting". Leakage of the gas through the cracks, and pitting of the electrodes, will cause degradation in the performance of the tube, with the result that the intensity of the light emitted from the flash tube will gradually decrease even though the same amount of the electrical energy is supplied to the tube. Performance of the flash tube will also degrade when the capacitor, particularly the dielectric material thereof, deteriorates over time. The deterioration is faster when the operational voltage of the flash tube is increased.

For applications where a predetermined amount of light is expected, degradation of the flash tube may produce undesirable results. For example, one such application is disclosed in U.S. Pat. No. 5,151,595, where a flash with a duration of 200 microseconds and beam intensity of 1500 BWPS (beam watt per second) is preferred for operation of an imaging device. If the operating voltage of the flash tube is set to produce 1500 BWPS exactly, degradation of the flash tube would adversely affect effectiveness of the device, as the intensity will subsequently decrease to below 1500 BWPS. To allow for such degradation, the voltage across the electrodes can be increased to set the initial light intensity at a level substantially higher than the required 1500 BWPS (i.e., to increase the margin of the intensity) so as to prolong the time in which the degradation will cause the intensity to fall below the required 1500 BWPS. However, the rate in which the flash tube degrades will increase when the voltage across the electrodes is increased, because a higher voltage will accelerate pitting of the electrodes and deterioration of the capacitor. Moreover, operating the flash tube at a higher voltage will raise the temperature of the flash tube, which in turn will accelerate cracking of the envelope.

What is needed is a technique for prolonging the effective life span of the flash tube in producing light with a preferred intensity.

SUMMARY OF THE INVENTION

The present invention provides a flash device which includes a source of electrical energy, a flash tube generating light flashes in response to the electrical energy and means for adjusting the electrical energy supplied to the flash tube in response to light generated by the flash tube.

According to one embodiment, the energy is adjusted by monitoring the amount of light from the flash tube and shunting the electrical energy supplied to the flash tube when a predetermined amount of light has been emitted.

According to another embodiment, a minimum amount of electrical energy is supplied to the flash tube. The energy is adjusted by increasing the electrical energy to the flash tube as the effectiveness of the flash tube decreases.

In another aspect, the present invention provides a method of operating a flash tube, which includes the steps of supplying electrical energy to the flash tube to cause the flash tube to emit light, monitoring the light from the flash tube and adjusting the electrical energy supplied to the flash tube in response to the monitoring step.

DESCRIPTION OF THE PREFERRED EMBODIMENT

Figure 1:
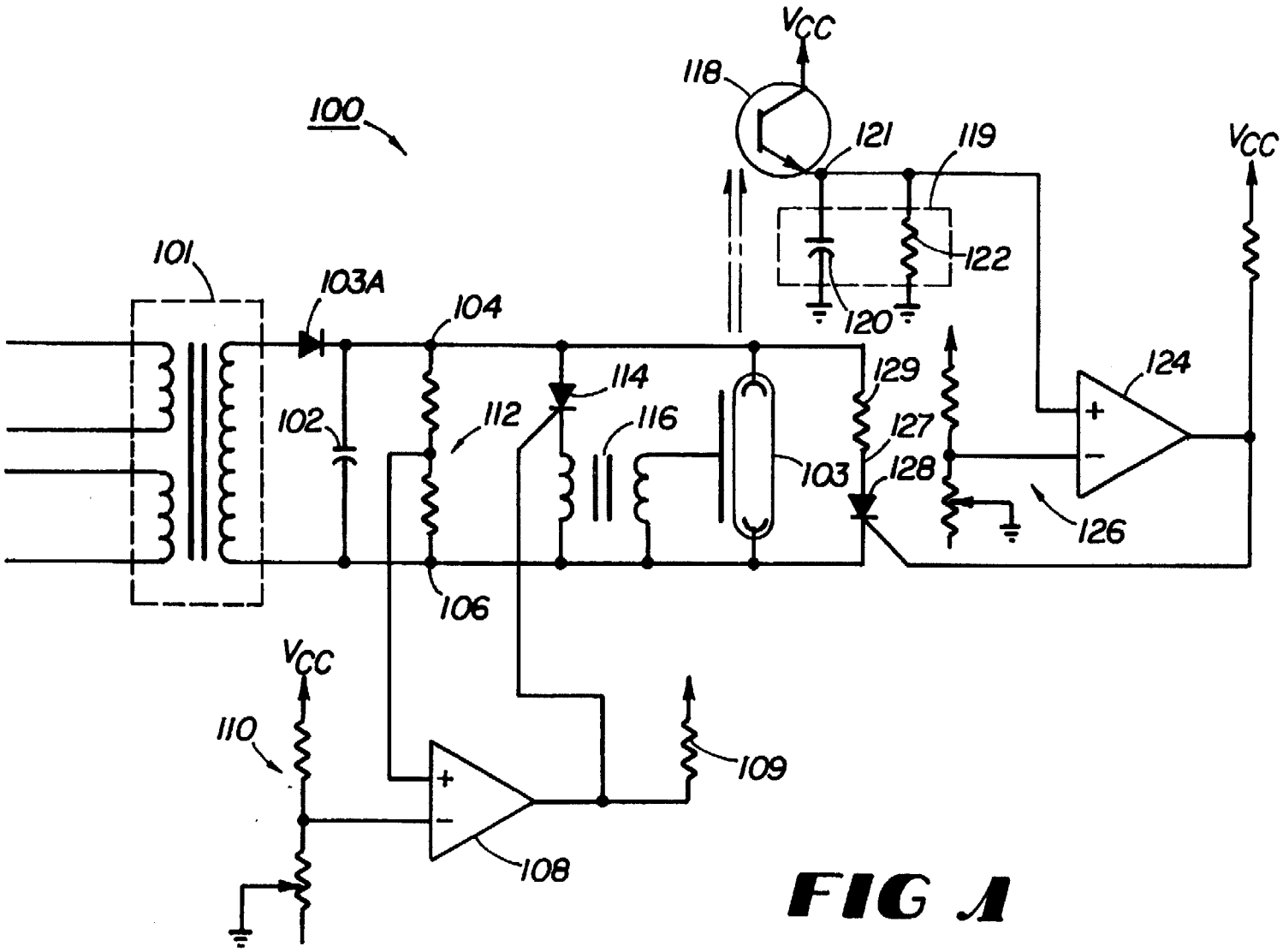
FIG. 1 is a schematic circuit diagram of a flash tube device according to one embodiment of the present invention.

FIG. 1 is a schematic circuit diagram showing in general one implementation of the flash device 100 according to the present invention.

The flash device 100 has a flash tube 103 which is connected across the nodes 104 and 106. Also connected across the nodes 104 and 106 is a capacitor 102 and a charging circuit 101 for charging the capacitor 102. The capacitor 102 can be a polarized capacitor which can accept an electrical charge at only one polarity (e.g., when the voltage at node 104 is positive with respect to node 106). If a polarized capacitor is not used, a rectifying circuit, such as a diode 103 as shown in FIG. 1, can be connected between the charging circuit 101 and the capacitor 102.

As the capacitor 102 is charged, the voltage across the nodes 104 and 106 rises. The voltage across nodes 104 and 106 is monitored by a triggering circuit which, according to this embodiment, includes a comparator circuit 108. A negative input of the comparator circuit 108 is connected to a reference voltage, which is derived from a voltage source through a voltage divider 110. A positive input of the comparator circuit 108 is connected through a voltage divider 112 to monitor the voltage at node 104. The output of the comparator circuit 108 is used to control a current switch, such as a SCR 114. Resistor 109 at the output of the comparator circuit 108 is a pull-up resistor and is needed only when the comparator circuit 108 is implemented with a certain technology (e.g., open-collector).

With reference to FIGS. 2*a*–2*d*, line 30 shows the voltage across the charging capacitor 102. At time t1, when the voltage at node 104 increases to a level where the voltage at the positive input of the comparator circuit 108 is greater than the reference voltage, the SCR 114 is activated by the output of the comparator circuit 108. When the SCR 114 is activated, it passes a current through the primary winding of a trigger transformer 116. As a result, a high triggering voltage is present at the secondary winding of the trigger transformer 116. This high voltage ionizes the gas in flash tube 103 and permits discharge of the energy stored in capacitor 102. When the gas in the flash tube 103 is ionized, it discharges the electric charge stored in capacitor 102 and emits light. The light energy produced by the flash tube 103 increases, as shown at time t1 of line 34 in FIG. 2*b* and line 42 at time t1 in FIG. 2*d*, which shows the line 34 with the timing scale expanded by about 20 times. At the same time, the voltage at node 104 begins to drop, as shown in line 30 of FIG. 2*a*.

The light emitted from the flash tube 103 is monitored by a monitoring device. The monitoring device includes a photo detector, such as a photo transistor 118, which senses the light emitted from the flash tube 103 and produces an electric current in response thereto. At time t1, when light begins to emit from the flash tube 103, the current produced by the photo transistor 118 begins to increase, as shown in line 34 of FIG. 2*b* and line 42 of FIG. 2*d* between time t1–t2. In the preferred embodiment, the energy produced by the photo transistor 118 is accumulated, such as by integrating the electric current from the photo transistor 118 by an integrator circuit 119, formed by a capacitor 120 and a resistor 122 connected in parallel. The output of the integrator circuit 119, which is the voltage at node 121, represents a time integral of current produced by the photo transistor 118. As current continues to be produced by the photo transistor 118, the voltage at the output of the integrator 119 increases, as shown in line 40 of FIG. 2*c*. Since the current produced by the photo transistor 118 is a function of the light intensity of the flash tube 103, the output of the integrator circuit 119 is a time integral of the light intensity from the flash tube 103. In other words, the output of the integrator circuit 119 represents the total amount of light produced by the flash tube 103 and will increase as current is produced by the photo transistor 118.

In an ideal implementation, when the total amount of light emitted from the flash tube 103 has exceeded a required level, the flash tube 103 can be shut off from the capacitor 102. This ideal implementation has two advantages. The first advantage is that the electric charge remaining in the capacitor 102 can be preserved for the subsequent flash. The second advantage is that, if the electric current to the flash tube 103 can be immediately cut off, degradation of the flash tube 103 due to the above-described reasons can be stopped immediately. However, because of the high discharge voltage, instantaneous shut-off of the flash tube 103 is not practical. Therefore, in the preferred embodiment, instead of completely shutting off the flash tube 103, the electric current to the flash tube 103 is shunted to reduce the above degradation thereto.

Figure 2A:
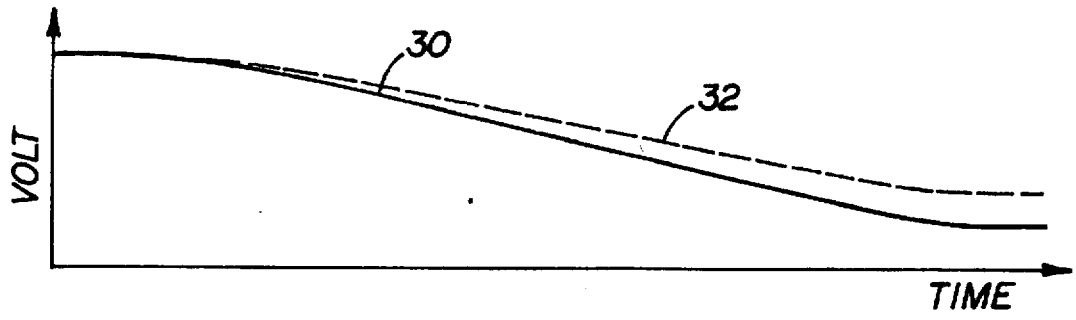
FIG. 2*a* is a timing diagram showing the voltage across the charging capacitor and the voltage across the electrodes in producing a flash of the flash tube of FIG. 1 with the shunting circuit in operation.
Figure 2B:
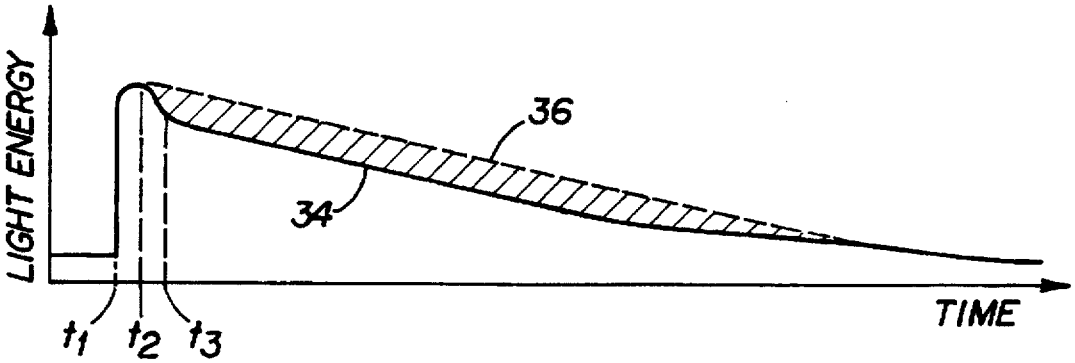
FIG. 2*b* is a timing diagram showing the light energy from the flash tube without shunting and the light energy from the flash tube when shunting according to the present invention is provided.
Figure 2C:
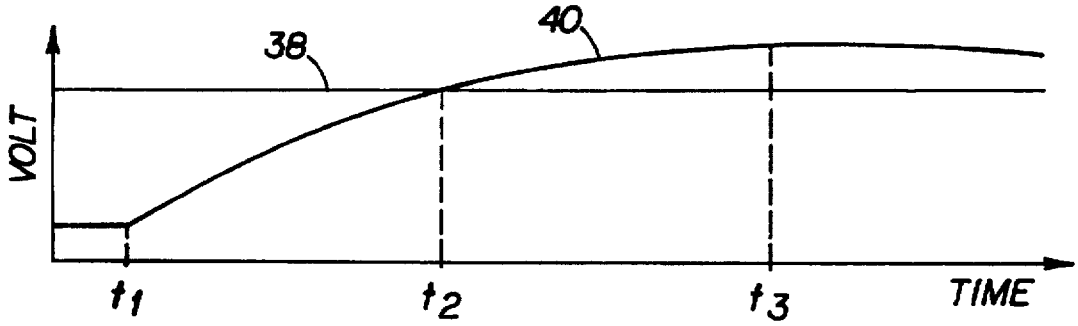
FIG. 2*c* is a timing diagram showing the output of the integrator between the time period t1–t3 shown in FIG. 2*b;*
Figure 2D:
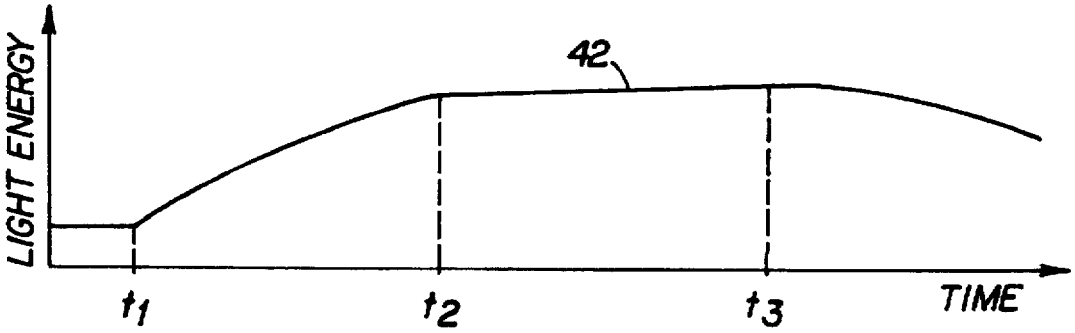
FIG. 2*d* is a timing diagram showing line 34 of FIG. 2*b* between time t1–t3 at an expanded time scale.

As the flash tube 103 continues to emit light, the photo transistor 118 continues to produce electric current, and the voltage at node 121, the output of the integrator 119, continues to rise, as shown in line 40 of FIG. 2*c*. The voltage at the output of the integrator circuit 119 is applied to a positive input of a comparator circuit 124. When the voltage at the positive input of the comparator circuit 124 rises to a predetermined level or threshold (represented by line 38 of FIG. 2*c*) set at the negative input of the comparator circuit 124, an output signal is produced by the comparator circuit 124 to activate a shunting device, such as a SCR 128. This occurs at t2 (see FIG. 2*c*). When the SCR 128 is activated, a portion of the current to the flash tube 103 is diverted through a resistor 129 connected in series with SCR 128. As a result, the electrical energy supplied to the flash tube 103 is reduced by an amount dissipated by resistor 129. The energy of the light emitted by the flash tube 103 is thereby decreased, with the result that at time t2, the light energy from the flash tube 103 begins to level off, as shown in line 42 of FIG. 2*d*, and will subsequently drop. The voltage at node 104 therefore drops at a faster rate (see line 30 of FIG. 2*a*) as compared to the rate of decrease when shunting is not provided (see line 32 of FIG. 2*a*). By diverting a portion of the electrical current from the flash tube 103, the light energy produced by the flash tube 103 will drop at a faster rate (see line 34 of FIG. 2*b*), as compared to the rate when shunting is not provided (see line 36 of FIG. 2*b*), and the above described degradation of the flash tube 103 is slowed.

Figure 3:
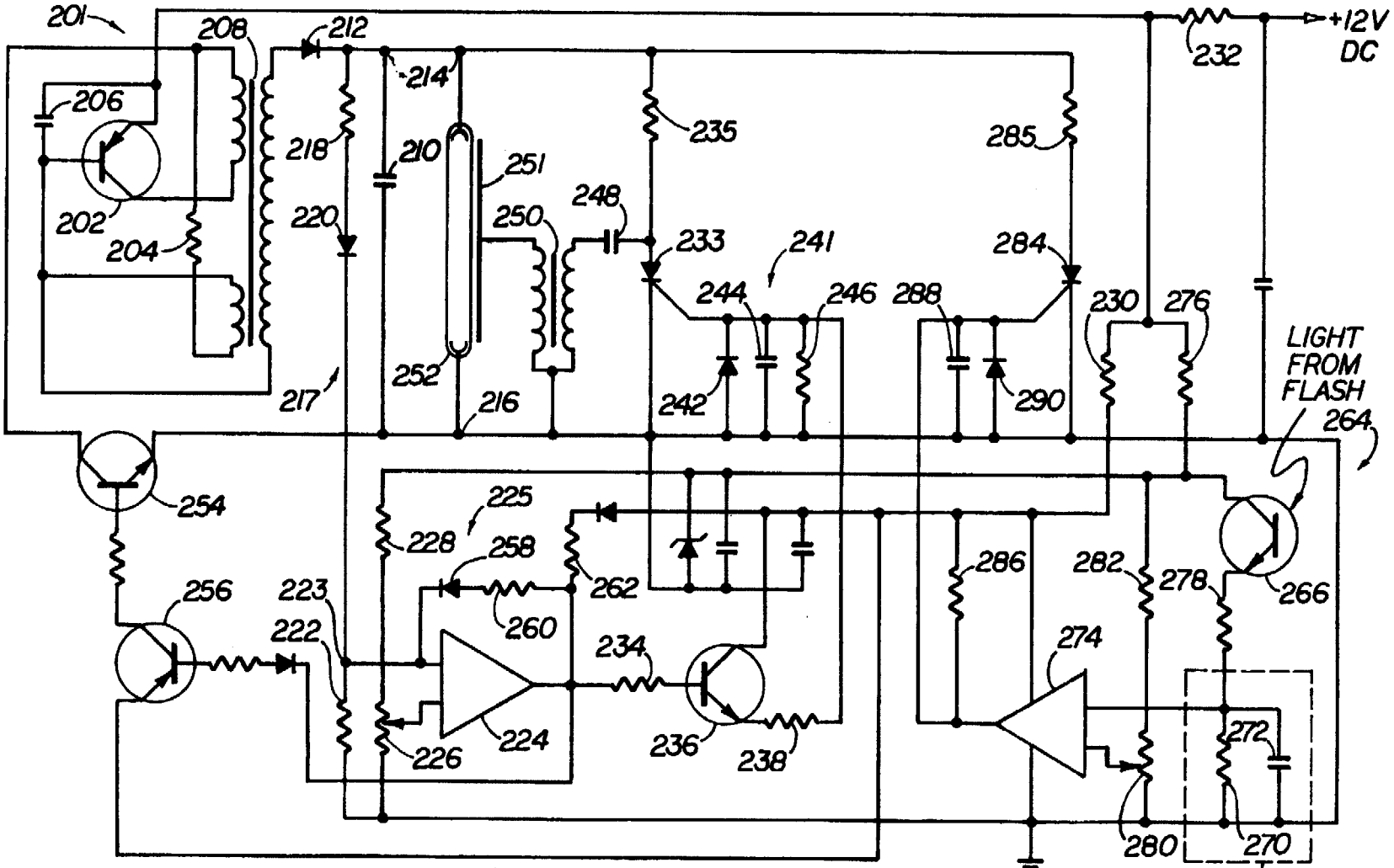
FIG. 3 shows a detailed embodiment of a flash tube device according to an embodiment of the present invention.

A presently preferred implementation of the flash circuit 100 is shown in FIG. 3.

An alternating current (A.C.) generator 201, which includes a conventional tickle oscillator formed by transistor 202, resistor 204 and capacitor 206, generates an A.C. signal which is applied to the primary winding of a transformer 208 to provide a step-up voltage at the secondary winding thereof. The voltage at the secondary winding of the transformer 208 is applied through a rectifying diode 212 to the charge capacitor 210 connected between nodes 214 and 216.

The voltage across the charge capacitor 210 is monitored by a voltage divider circuit 217 formed by a resistor 218, a diode 220 and a resistor 222. The voltage at the node 223 of the divider circuit 217 is applied to a positive input of a comparator circuit 224. The voltage is monitored against a reference voltage which is derived from a voltage source (12 VDC) through a divider circuit 225 formed by resistors 226 (which is variable), 228, 230 and 232. The output of the comparator circuit 224 is applied to a current switch, such as an SCR 233, through a driver circuit which is formed by resistor 234, transistor 236 and resistor 238. When the voltage across the charge capacitor 210 rises to a predetermined voltage level (typically at 270 volt), as set by the divider circuit 225, SCR 233 will turn on. A conventional "snubber network" 239, which is formed by a diode 242, capacitor 244 and resistor 246, is used to prevent voltage spikes at the gate of SCR 233.

When SCR 233 is turned on, it causes a voltage drop at capacitor 248, which is connected to the primary winding of transformer 250. The voltage drop at the primary winding of transformer 250 causes a corresponding voltage rise at the secondary winding of transformer 250 which is connected to the trigger electrode 251 of the flash tube 252. When the voltage at the trigger electrode 251 of the flash tube 252 rises to a predefined level (typically at 15 KV), the gas in the flash tube 252 is ionized and the flash tube 252 discharges the electric charge stored in capacitor 210, emitting light.

When the flash tube 252 discharges, operation of the oscillator 201 is shut off by transistor 254, which is driven by transistor 256 in response to the voltage at the output of the comparator circuit 224. Diode 258 and resistors 260 and 262 operate in combination to provide a hysteresis for keeping SCR 233 on when the flash tube 252 discharges.

The light emitted by the flash tube 252 is received by a monitor circuit 264 which includes a photo detector, such as photo transistor 266. In response to the emitted light, photo transistor 266 produces a current which is a function of the intensity of the light generated by the flash tube 252. The normalized magnitude of the current can be controlled by a resistor 278.

The electric current from photo transistor 266 is integrated by an integrator circuit 268 which includes a resistor 270 and a capacitor 272. As the electric current is integrated, the voltage at the capacitor 272 increases. Thus, the voltage at the capacitor 272 is a function of the intensity of the light as well as the time duration in which the light is emitted. The voltage at the capacitor 272 is applied to a first input of a comparator circuit 274. The second input of the comparator circuit 274 is connected to a reference voltage provided from the voltage source through a voltage divider circuit which includes a variable resistor 280, and resistors 282, 276 and 232.

The output of the comparator circuit 274 is used to control a current switch, such as a SCR 284. Resistor 286 at the output of the comparator circuit 274 is a pull-up resistor. Capacitor 288 and diode 290 together form a snubber circuit to prevent spikes at the gate of SCR 284.

Figure 7:
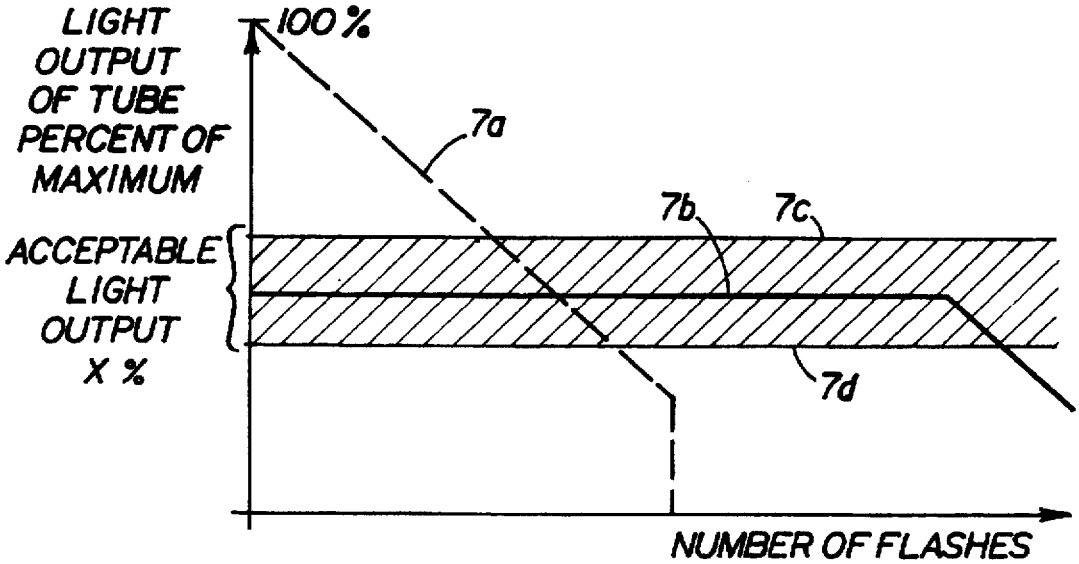
FIG. 7 shows one important result of the present invention.

As the current produced by the photo-transistor 266 is integrated, the voltage at the first input of the comparator circuit 266 rises. When the voltage at the first input of the comparator circuit 266 reaches the reference level, a signal is produced by the comparator circuit 274 to turn on SCR 284. When SCR 284 is turned on, it diverts some of the current from the flash tube 251. The current passes through and is thereby dissipated by a resistor 285 (which has a resistance of about 10 ohm in the embodiment). With reference to FIG. 7, if the current of the flash tube, 103 or 251, is not diverted in accordance with the present invention, the light output would start at the maximum output level as shown in line 7*a*. The light output, however, would gradually fall as a function of the number of flashes produced, until it is below the preferred level. However, if the light output is diverted in accordance with the present invention, so that it is lower than the maximum as shown in line 7*b*, but within the preferred levels 7*c* and 7*d*, the life span during which the light output remains within the preferred levels 7*c* and 7*d* will be extended, as shown in line 7*b*.

The flash tube device according to the present invention can be used advantageously for providing flashes of light in apparatuses such as those disclosed in U.S. Pat. No. 5,151,595 (the '595 patent), which is incorporated herein by reference.

Figure 4A:
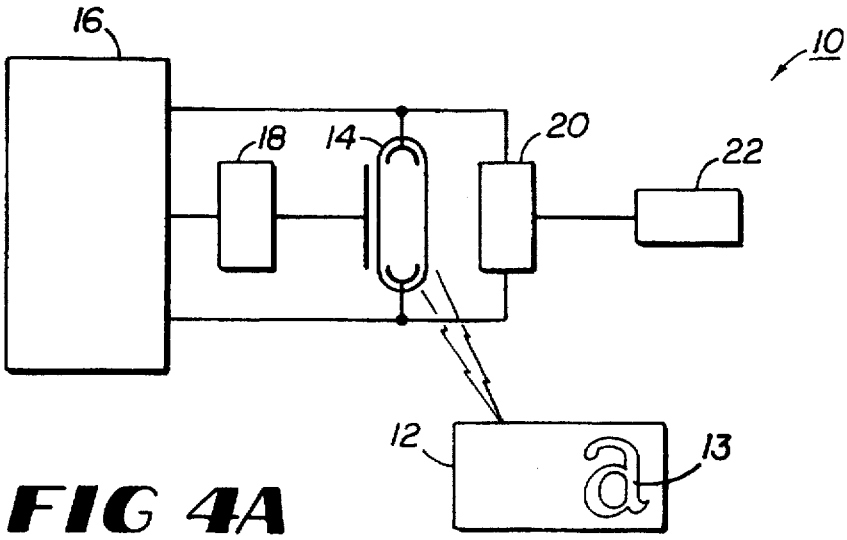
FIG. 4*a* is a block diagram showing how light is monitored according to one embodiment of the present invention.
Figure 4B:
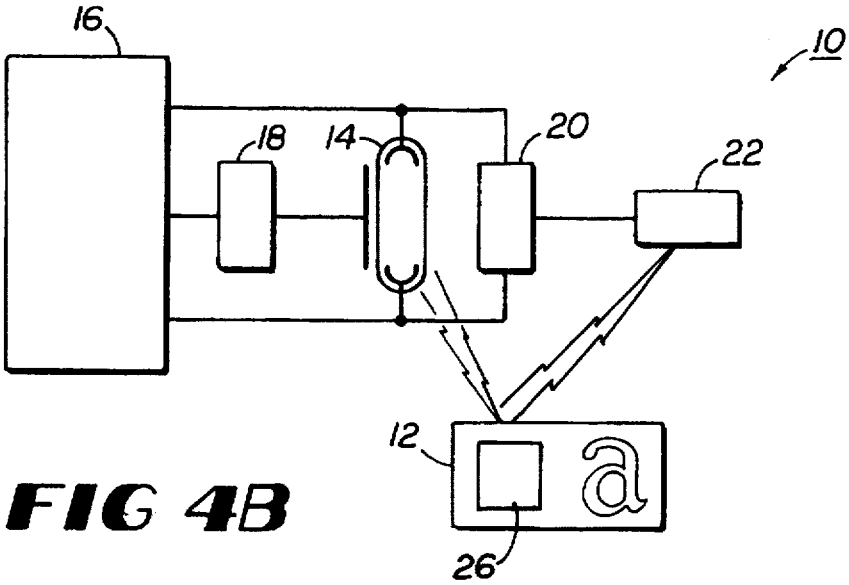
FIG. 4*b* is a block diagram showing how light is monitored according to another embodiment of the present invention.
Figure 4C:
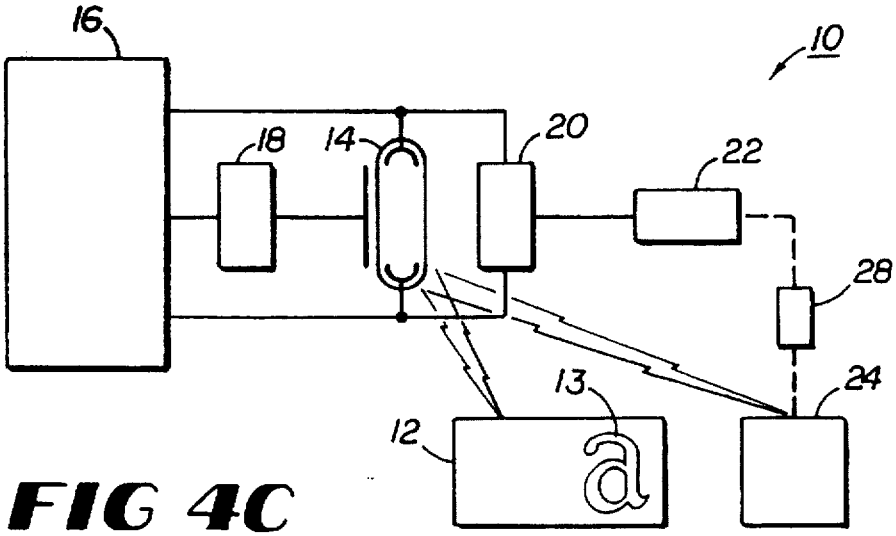
FIG. 4*c* is a block diagram showing how light is monitored according to yet another embodiment of the present invention.

FIGS. 4*a*–4*c* are block diagrams of the imaging devices 10 each of which has a substrate 12 bearing an infrared image producing layer 13 (for example, see the '595 patent). The light source of the imaging device 10 is provided by a flash tube device which embodies the present invention. The flash tube device includes a flash tube 14 which receives electrical energy from a source of electricity 16 and emits a flash of visible light in response thereto to cause latent heat properties of the infrared layer 13 to convert visible light into far infrared light.

The flash of visible light is generated as described above by charging a capacitor (not shown) within the electrical source 16 to a predetermined voltage. When the capacitor is charged to the predetermined voltage, a trigger signal is applied by a trigger circuit 18 to the trigger electrode of the flash tube 14 and to cause the flash tube 14 to discharge. During the discharge, the flash tube 14 emits a visible flash of light. The light emitted by the flash tube 14 is monitored by a monitor circuit 22.

The monitor circuit 22 can monitor the light either by sensing the light directly from the flash tube 14 as shown in FIG. 4*a*, or by sensing a reflection of the light from the substrate 12 as shown in FIG. 4*b*. If the light is monitored by sensing light reflected from the substrate 12, a special area 26, not covered by the infrared image producing layer 13, is reserved on the substrate 12 to provide the reflection. This is to ensure that the light is reflected from an area having a predetermined reflectivity unaffected by the layer 13.

With reference to FIG. 4*c*, another way of monitoring the amount of light emitted from the flash tube 14 is to provide a photo-reactive material 24, such as a photo chromic material, which can change the wavelength of the light in real-time. Changes in the photo-reactive material are then sensed by a sensing device 28 which sends a signal to the monitor circuit 22 in response thereto.

When the monitor circuit 22 detects that a predetermined amount of light has been emitted from the flash tube 14, it activates a circuit 20 to reduce the electrical energy supplied to the flash tube 14. The electrical energy supplied to flash tube 14 is reduced by diverting some of the electric current away from the flash tube 14, and dissipating the current, for example, by a shunt resistor.

The above embodiments are described for the purposes of illustrating the present invention. It will be understood by those skilled in the art that certain modifications and changes may be made to the above embodiment.

Figure 5:
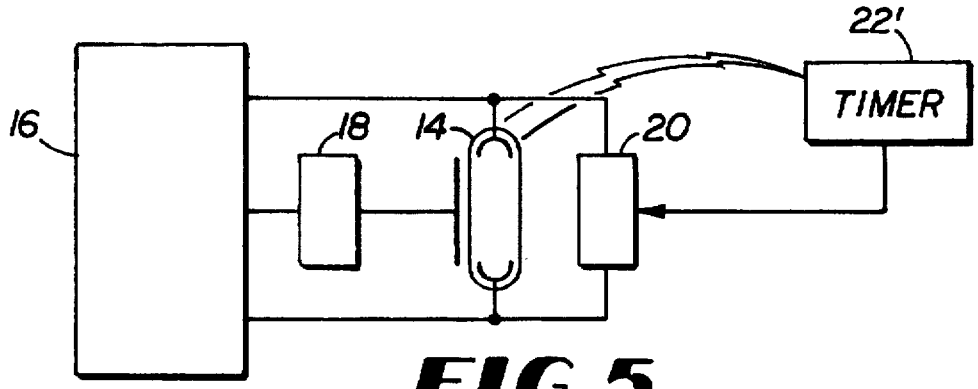
FIG. 5 is an alternative embodiment of a flash tube device having means for prolonging the effective life span of the flash tube.

For example, instead of integrating the current generated from the photo-detector, the amount of light to be generated from the flash tube 14 can be fixed by fixing the time during which light is emitted from the flash tube. With reference to FIG. 5, the light emitted from the flash tube 14 is received by a monitor device 22' which starts a timer in response to the emitted light. When the timer reaches a predefined value, a signal is sent to the shunt circuit 20 to divert the electric current from the flash tube 14.

Figure 6:
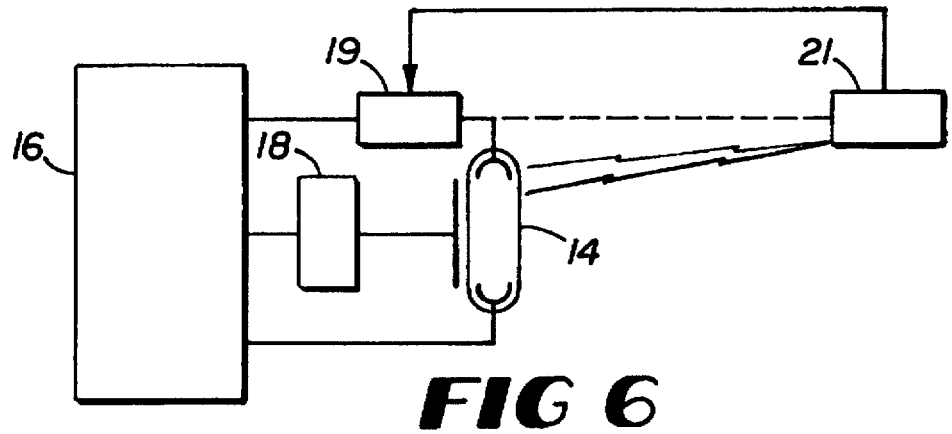
FIG. 6 is yet another embodiment of a flash tube device having means for prolonging the effective life span of the flash tube.

An alternative technique for prolonging the effective life span of the flash tube is to set the charge voltage of the charge capacitor to the minimum required level. For example, in the above-mentioned applications, the charge voltage is initially set so that the flash tube emits just 1500 BWPS. With reference to FIG. 6, a counter 21 is provided to count the number of flashes produced from the flash tube 14. This can be accomplished by either monitoring the light emitted from the flash tube 14 or the number of times the flash tube 14 has been charged/discharged. The counter 21 is connected to a circuit 19 which operates to increase the charge voltage of the charge capacitor. That is, the charge voltage is automatically increased as a function of the flashes already produced by the flash tube 14 (e.g., raising the reference voltage of the trigger circuit by m volt when the flash tube has produced n flashes). Referring back to the circuits shown respectively in FIGS. 1 and 3, increasing the charge voltage can be accomplished by raising the reference voltage of the trigger circuit. However, although the life span of the flash tube 14 can be extended, this implementation will not control the amount of light from the tube in a controlled manner over the life of the flash tube 14.

Therefore, it will be understood that certain modifications and changes may be made to the above embodiment. However, any such changes and modifications are within the scope of the invention as defined in the following claims.

What is claimed is:

1. A flash device comprising:

a. a source of electrical energy;

b. a flash tube adapted to emit light repeatedly in response to the electrical energy; and c. means for adjusting the electrical energy in response to light emission of the flash tube, comprising:

i. means for determining the number of light emissions of the flash tube; and ii. means, comprising an electrical circuit, for increasing the electrical energy to the flash tube in response to the number of light emissions determined by the determining means.

2. A flash device comprising:

a. a source of electrical energy;

b. a flash tube emitting light in response to the electrical energy, the electrical energy resulting in current of a first amount flowing to the flash tube; and c. means, comprising a shunting circuit, for adjusting the electrical energy in response to light emission of the flash tube by diverting away from the flash tube a second amount of current, which second amount of current is only a portion of the first amount of current.

3. A flash device according to claim 2 in which the shunting circuit (i) consists of an SCR connected to a resistor and (ii) is connected in parallel with the flash tube.

* * * * *